United States Patent [19]

Goldfarb

[11] Patent Number: 4,538,803

[45] Date of Patent: Sep. 3, 1985

[54] WORKING MUSICAL CAROUSEL KIT WITH ROCKING FIGURES

[76] Inventor: Adolph E. Goldfarb, 1432 S. East Wind Cir., Westlake Village, Calif. 91361

[21] Appl. No.: 579,208

[22] Filed: Feb. 10, 1984

[51] Int. Cl.[3] ..... A63H 13/20

[52] U.S. Cl. ..... 272/31 R

[58] Field of Search ..... 272/31 R, 39, 43, 44, 272/45, 46, 47, 48, 52.5, 53.1

[56] References Cited

U.S. PATENT DOCUMENTS

| | | | |
|---|---|---|---|
| 154,729 | 9/1874 | Thompson | 272/31 R |
| 1,358,768 | 11/1920 | Maisano | 272/31 R |
| 2,444,906 | 7/1948 | Assendrup | 272/31 R |

FOREIGN PATENT DOCUMENTS

| | | | |
|---|---|---|---|
| 178224 | 11/1906 | Fed. Rep. of Germany | 272/48 |

*Primary Examiner*—Robert A. Hafer

*Assistant Examiner*—Arnold W. Kramer

*Attorney, Agent, or Firm*—Romney, Golant, Martin & Ashen

[57] ABSTRACT

The carousel when assembled by the consumer has striking animation effects (considering that the mechanism is made primarily of wood), including a rocking motion of animal figurines. The rocking results from mounting each figurine on the end of a horizontally rotatable shaft, supported from the carousel; a crank keyed to the same shaft extends down through a log slot in the carousel deck.

Under the deck is a stationary disc. In this disc is a series of holes, in a circular pattern with radius equal to that of the crank locus. The crank periodically drops into these holes, as they sequentially move under the crank; the crank rotates upwardly as the trailing edge of each hole sequentially engages the crank.

This oscillation of the crank is transmitted by the horizontal shaft to the figurines.

1 Claim, 2 Drawing Figures

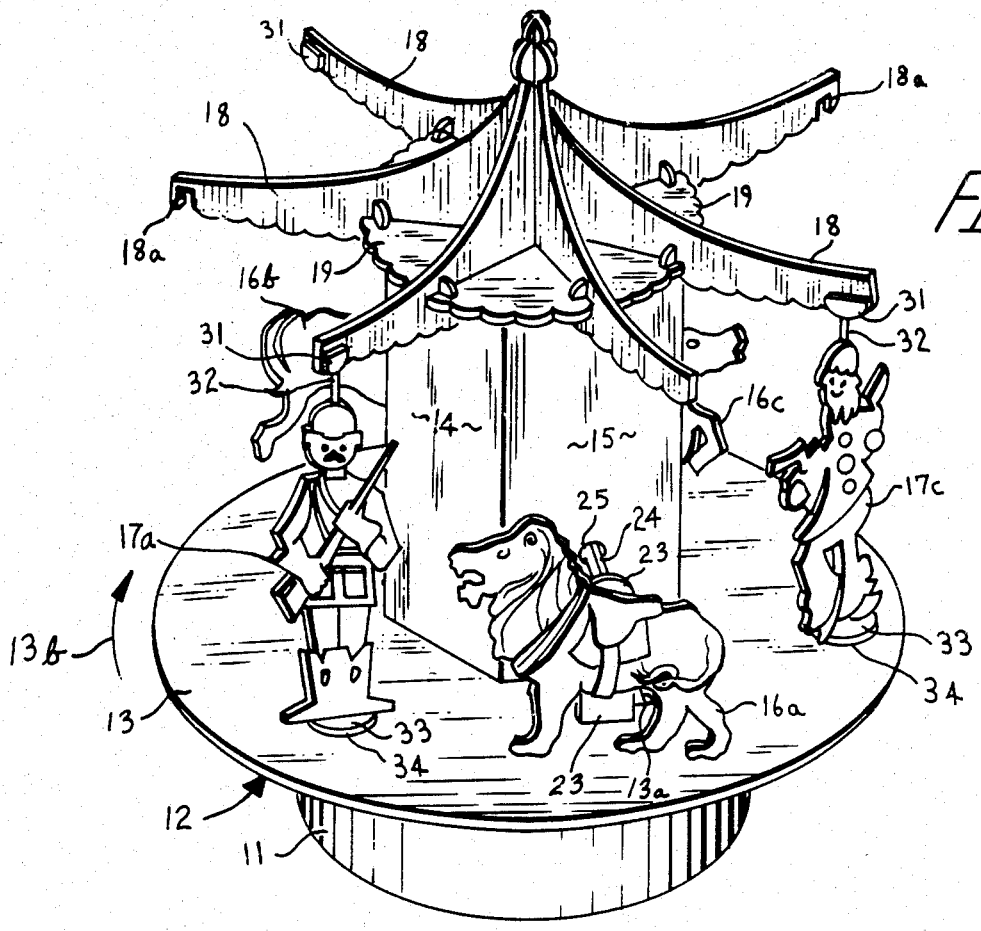
Fig. 1
Fig. 2
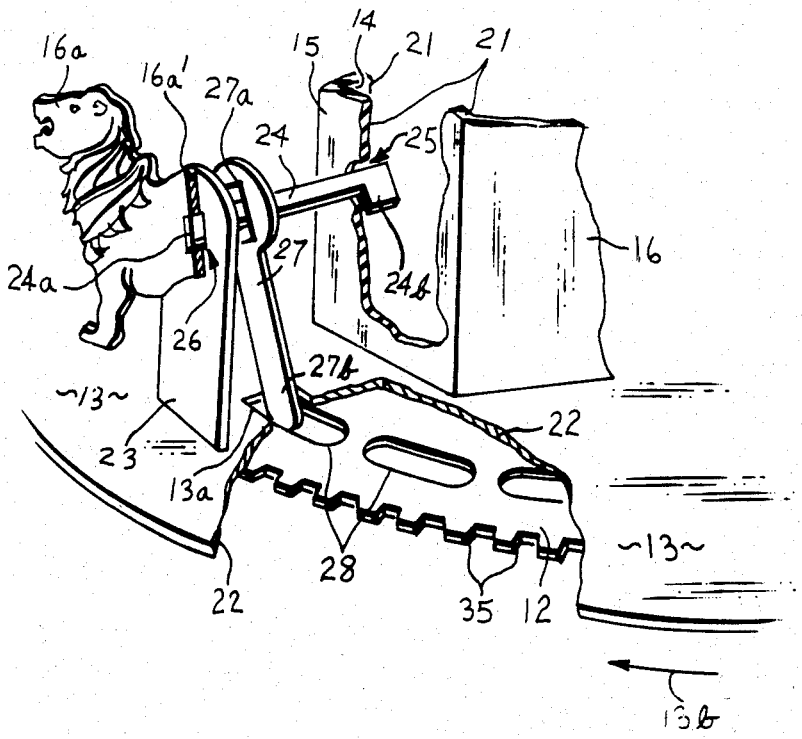

WORKING MUSICAL CAROUSEL KIT WITH ROCKING FIGURES

BACKGROUND

1. Field of the Invention

This invention relates generally to do-it-yourself-kit novelty items, and more particularly to a music-box-powered wooden carousel with moving figurines.

2. Prior Art

Many music-box windup motors have been made to power carousels, with various kinds of moving figurines on or in association with the carousels.

Generally such products, however, have been made from stamped or molded metal parts and assembled by paid workers. Animation of such figurines primarily by relatively simple, inexpensive wooden components to be assembled by purchasers of do-it-yourself "kits" is at another level entirely. We are not familiar with any earlier music-box-powered carousel which has provided such animation.

BRIEF SUMMARY OF THE DISCLOSURE

Our invention provides a carousel that is powered from a music box and that has figurines animated primarily by simple, inexpensive wooden parts adapted for assembly by untrained individual owners of "do-it-yourself" hobby kits.

The carousel includes a base, which defines a recess for the music box. The base also has an elevated annular platform surrounding the recess. This platform defines a series of relatively short holes, arrayed in a circular pattern whose center is at the center of rotation of the carousel. A commercial music box is mounted in the base. The platform may be made of wood without compromising operation of the mechanism to be described, but the platform is not readily visible after assembly, and for the sake of convenience and economy we prefer to form the platform and base together in plastic.

A wooden carousel deck is supported, for rotation in a generally horizontal plane above the platform, from an output shaft of the music box. Defined in the deck is a relatively long slot, which is spaced from the center of rotation of the carousel deck. The slot is spaced from the rotational center of the deck by an amount approximately equal to the radius of the previously mentioned circular pattern of short holes in the platform.

Supported from the carousel deck, and rotating with the carousel deck, is a pair of wooden bearing posts. Each post defines an opening, spaced above the deck, that serves as a bearing. A wooden shaft is supported (substantially horizontally) between the bearings in the two posts, and rotatably relative to the two bearings. The shaft is thus rotatable relative to the two posts, and relative to the carousel deck. A wooden crank is keyed to and depends from the shaft. The crank hangs down through the relatively long slot and into contact with the platform.

During rotation of the carousel the bottom end of the crank falls into the short holes when the leading edge of each short hole comes into position below the slot. The bottom end of the crank rises when the trailing edge of each short hole comes into position below the slot. This oscillation of the crank is transmitted to the wooden shaft, causing the shaft to oscillate in rotation relative to the bearings—and thus relative to the posts, and to the deck. A figurine is secured to the end of the shaft and oscillates with the shaft as the carousel rotates.

The foregoing operational principles and advantages of the present invention will be more fully appreciated upon consideration of the following detailed description, with reference to the appended drawings, of which:

BRIEF DESCRIPTION OF THE DRAWINGS

FIG. 1 is a general perspective drawing of a preferred embodiment of our invention.

FIG. 2 is a similar drawing, but enlarged and partly broken away, showing the mechanical details of suspension and animation of certain figurines in the FIG. 1 embodiment.

DETAILED DESCRIPTION OF THE PREFERRED EMBODIMENT

As shown in FIG. 1, the preferred embodiment has the form of a carousel mounted to a base 11, within which is positioned a music-box movement and music drum and tines, all conventional and not here illustrated. The music-box movement has a vertical output shaft which drives the carousel deck 13 clockwise as indicated by the arrow 13*b*.

Upstanding at the center of the deck 13 is a central pillar formed of four generally vertical partitions, of which two are visible in the drawing as partitions 14 and 15. Mounted at the top of the central pillar are six generally radial canopy ribs 18. This central structure is locked together by means of a generally horizontal, generally circular brace 19.

The underside of each rib 18 is notched as at 18*a*, near the respective tips of the ribs. A small retaining plate 31 is secured at each side of each notch 18*a* to form with the notch a bearing for capture of a pivot pin 32—for purposes to be described. Three discs 33 are mounted in respective bearings 34, and extend downwardly through holes formed in the deck. Figurines 17*a* and 17*c* (and a third figurine concealed behind the central pillar in the drawing) preferably depicting human figures, are mounted to the respective discs 33, and formed at their top ends into the pivots pins 32 previously mentioned. Fixed to the discs 33 by means of shafts (not shown) extending through the deck 13. Fixed to the bottom ends of these unillustrated shafts beneath the deck 13 are respective planetary gears (not shown) which engage a sun gear 35 (FIG. 2) on a stationary platform 12 that forms the top of the base 11 and that is immediately below the rotating deck 13. This mechanism causes the figurines 17*a* and 17*c* to spin as the carousel rotates.

Other figurines 16*a*, 16*b* and 16*c*, preferably depicting animals, are spaced around the carousel deck 13 as illustrated. For definiteness I shall refer only to figurine 16*a*. This figurine is supported for rocking motion from mechanisms now to be described. A generally vertical post 23 supports the outboard end of a shaft 24, whose inboard end is supported in a rough bearing 25 formed in the partition 15.

Most of these same components are also illustrated in FIG. 2. Partition 16, hidden in FIG. 1, appears in FIG. 2. In FIG. 2 the partitions 14, 15 and 16, the deck 13, and the animal figurine 16*a* are all shown broken away at 21, 22, and 16*a*′ for a clearer view of the mechanism details. The shaft 24 can now be seen to pass through a rough bearing 26 near the top of the post 23. The inboard end of the shaft 24 is provided with a lateral extension or key 24*b* to prevent it from falling out of the bearing hole 25 in the partition. The extreme outboard end 24*a* of the shaft 24 is embedded or otherwise secured in or to the figurine 16*a* from the rear. A crank 27 is supported from the shaft 24, by a shaped hole 27*a* in the upper end of the crank; the hole 27*a* closely matches the cross-section of the shaft 24, so that the crank and shaft rotate together. The lower end 27*b* of the crank 27 projects downwardly through a slot 13*a* (see also FIG. 1) in the deck 13, and falls into one of the spaced holes 28 in the stationary platform 12—provided that the deck 13 is in a suitable position relative to the platform 12. When the deck 13 is in intermediate positions, the lower end 27*b* of the crank 27 engages and is raised by the platform surface 12.

Thus, rotation of the deck 13 over the platform 12 causes the crank 27 to oscillate about the shaft 24, and this oscillation is transmitted by the shaped hole 27*a* to the shaft 24 and thereby to the figurine 16*a*.

It is to be understood that all of the foregoing detailed descriptions are by way of example only, and not to be taken as limiting the scope of my invention—which is expressed only in the appended claims.

We claim:

1. A carousel powered from a music box and having figurines animated primarily by simple, inexpensive parts adapted for assembly by untrained individual owers of "do-it-yourself" hobby kits; the carousel comprising:

a base defining a recess for such music box and having an elevated annular platform surrounding the recess, the platform defining a series of relatively short holes in a circular pattern whose center is at the center of rotation of the carousel;

a commercial music box mounted in the base;

a carousel deck supported, for rotation in a generally horizontal plane above the platform from an output shaft of the music box;

a pillar upstanding from the center of the carousel deck having openings each serving as a bearing;

upstanding bearing posts supported from the carousel deck outward of the pillar and rotating with the carousel deck, each post defining an opening, spaced above the deck, that serves as a bearing;

the deck defining a relatively long slot adjacent each bearing post spaced from the center of rotation of the carousel deck by an amount approximately equal to the radius of the said circular pattern of relatively short holes in the platform;

shafts each supported substantially horizontally between one of the respective bearings in the bearing posts and one of the respective bearings in the pillar, and rotatable relative to its two bearings, and relative to its post and the pillar, and relative to the carousel deck;

a crank keyed to each shaft and depending therefrom through its respective relatively long slot and into contact with the platform;

whereby during rotation of the carousel the crank falls into the short holes when the leading edge of each short hole comes into position below the slot, and the crank rises when the trailing edge of each short hole comes into position below the slot, which oscillation of the crank is transmitted to the shaft, causing the shaft to oscillate in rotation relative to the bearings, post, pillar, and deck; and a figurine secured to the end of each shaft and oscillating with the shaft as the carousel rotates.

* * * * *